United States Patent [19]

DeSchutter

[11] 4,160,349

[45] Jul. 10, 1979

[54] INSULATING MODULAR PANEL UNITS

[76] Inventor: Camiel R. DeSchutter, 20907 Ardmore Pk., St. Clair Shores, Mich. 48081

[21] Appl. No.: 832,209

[22] Filed: Sep. 12, 1977

Related U.S. Application Data

[62] Division of Ser. No. 680,037, Apr. 26, 1976, abandoned.

[51] Int. Cl.[2] ..... E04B 5/52

[52] U.S. Cl. ..... 52/481; 52/821; 52/827

[58] Field of Search ..... 52/620, 629, 481, 615, 52/275, 616, 595, 476, 618, 592

[56] References Cited

U.S. PATENT DOCUMENTS

| | | | |
|---|---|---|---|
| 2,039,601 | 5/1936 | London | 52/618 X |
| 2,618,028 | 11/1952 | Baker | 52/592 X |
| 2,662,043 | 12/1953 | Clements | 52/615 X |
| 3,950,910 | 4/1976 | Pobanz | 52/618 |

*Primary Examiner*—Price C. Faw, Jr.
*Assistant Examiner*—Carl D. Friedman
*Attorney, Agent, or Firm*—Barnes, Kisselle, Raisch & Choate

[57] ABSTRACT

Modular panel units are constructed to provide an insulating barrier to heat, cold and sound. Tests on the modular units have proven the success of providing panel units which have maximum insulating properties. Panel members of insulating material and approximately ⅛ inch in thickness have rectangular elements applied to one face thereof in spaced horizontal position to form a structural element and a like panel member having rectangular elements disposed in spaced vertical position on one face thereof to form a second structural element. The structural elements are alternately sandwiched together with an air space therebetween and with facing reflecting surfaces on opposite faces which inhibits the passage of heat, cold and sound. The core thus formed has outer and inner surfaces which are covered on the outside with a finished material which may be bricks, plywood and the like while the inside may be plaster, have plasterboard or any other type of inner trim panel applied thereto in secured relation therewith. The panel units are produced in modular form so that they can be extended in length and have corners formed thereby so as to be employed as structural units on the building side walls and partitions as well as for the roof structure. The units may also be employed for non-structural supporting structure to form inner walls and the like.

31 Claims, 14 Drawing Figures

Fig. 1.
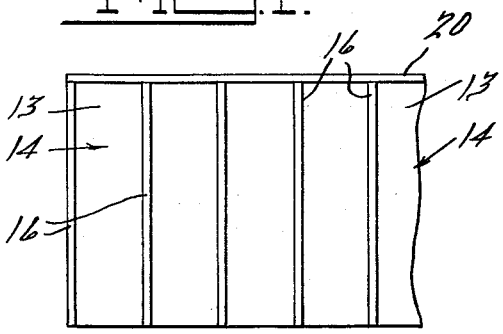
Fig. 2.
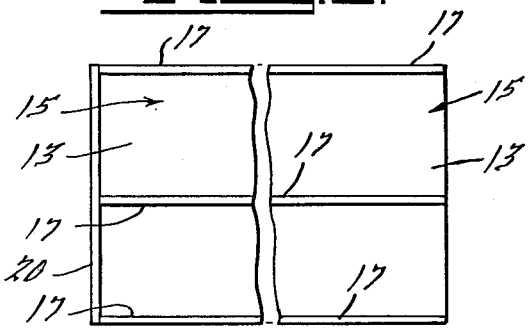
Fig. 3.
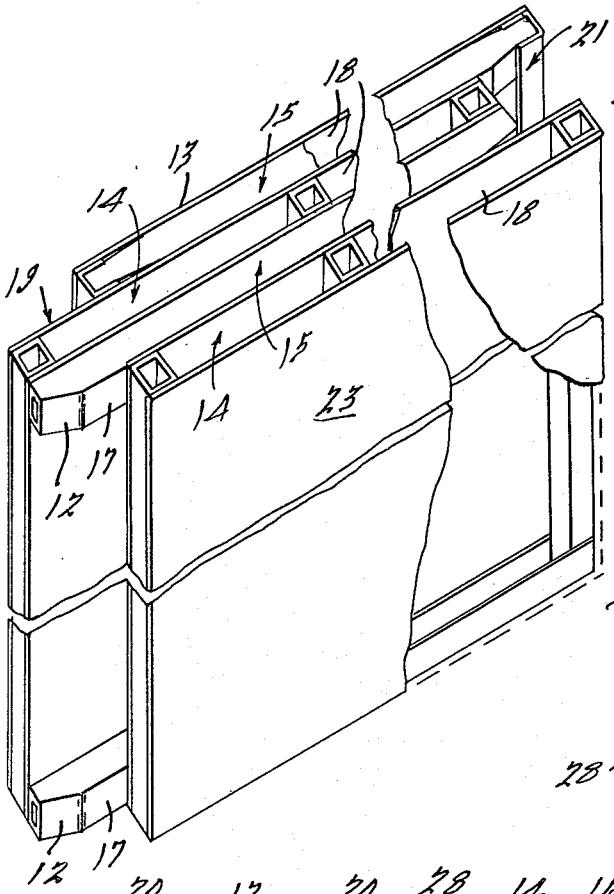
Fig. 4.
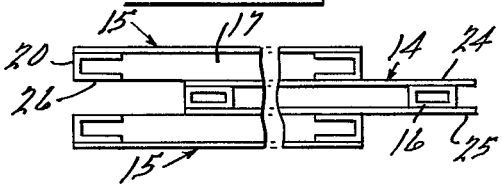
Fig. 5.
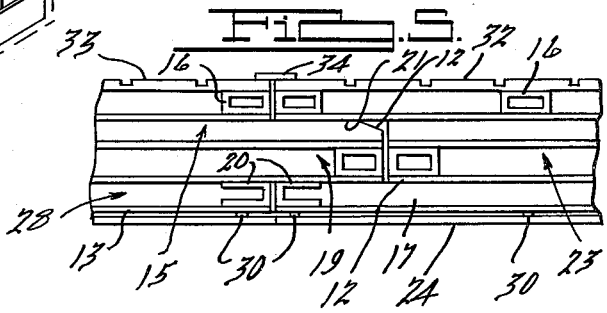
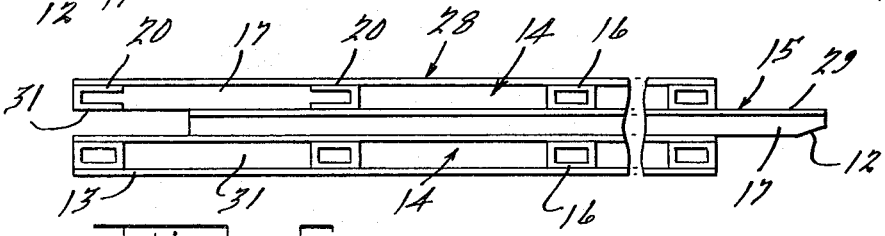
Fig. 6.

Fig. 7.
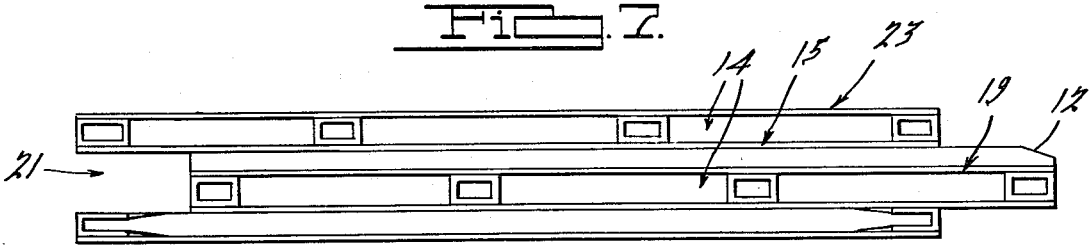
Fig. 8.
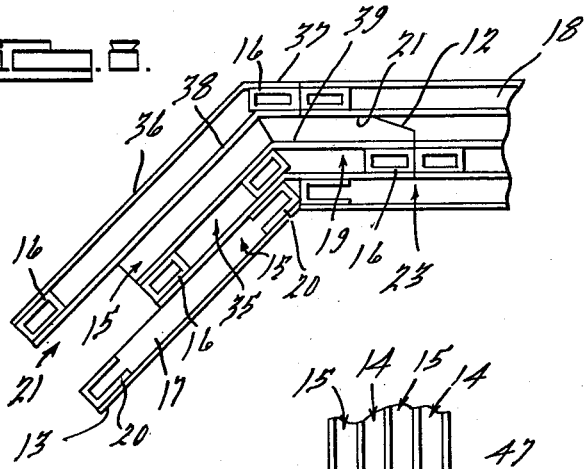
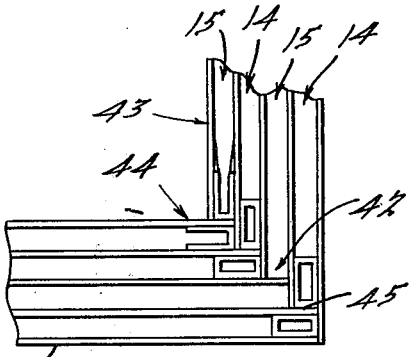
Fig. 9.
Fig. 10.
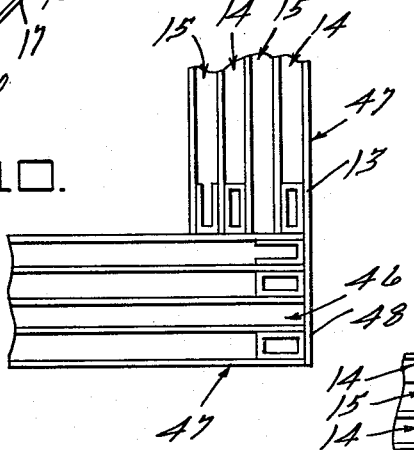
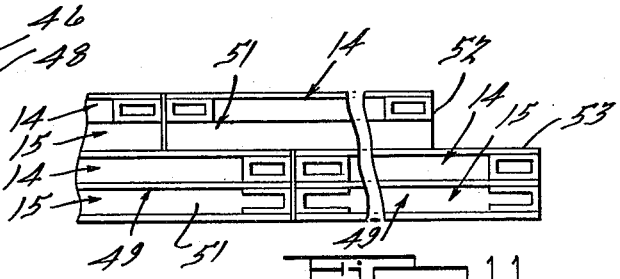
Fig. 11.
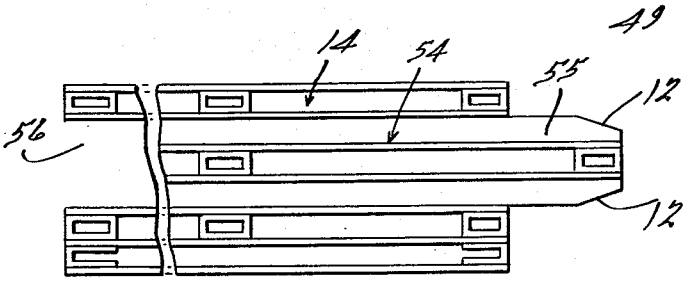
Fig. 12.
Fig. 13.
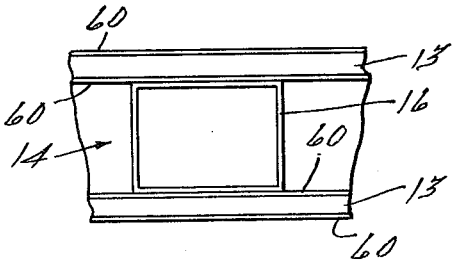
Fig. 14.
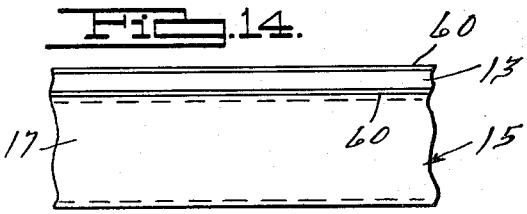

INSULATING MODULAR PANEL UNITS

This is a continuation of application Ser. No. 680,037, filed Apr. 26, 1976, now abandoned.

BACKGROUND OF THE INVENTION

While modular panel units have been constructed heretofor to resist the passage of heat, cold and sound, none have been constructed to a high degree of resistivity by scientifically constructing the core portion with spaced resistive pressboard having reflective surfaces facing each other.

BRIEF DESCRIPTION OF THE DRAWINGS

FIG. 1 is a view in elevation of an insulating panel member and vertically disposed spacer elements which forms a structural element of the present invention;

FIG. 2 is a view of structure, similar to that illustrated in FIG. 1, disclosing a like panel member and horizontally disposed like spacer elements which forms another structural element;

FIG. 3 is an enlarged broken perspective view of a modular panel unit made up from alternately disposed structural elements of FIGS. 1 and 2;

FIG. 4 is a view of structure, similar to that illustrated in FIG. 3, showing a thinner core unit formed from the structural elements;

FIG. 5 is a view of structure, similar to that illustrated in FIG. 3, showing a core unit having a plywood exterior and an interior facing of gypsum wallboard;

FIG. 6 is a view of structure, similar to that illustrated in FIG. 4, with a different arrangement of the structural elements illustrated in FIGS. 1 and 2;

FIG. 7 is a plan view of the structure illustrated in FIG. 3, showing a flat modular unit having a tongue and groove on opposite edges;

FIG. 8 is a broken view of structure, similar to that illustrated in FIG. 7, showing a modular unit forming a 45° corner;

FIG. 9 is a sectional view of structure, similar to that illustrated in FIG. 8, showing modular units forming a 90° corner by stepped mated ends;

FIG. 10 is a view of structure, similar to that illustrated in FIG. 9, showing a 90° corner formed by abutting ends;

FIG. 11 is a view of structure, similar to that illustrated in FIG. 7, showing another manner of connecting two modular units together to extend the length thereof;

FIG. 12 is a broken view of structure, similar to that illustrated in FIG. 7, showing a thicker assembly of structural elements to provide greater strength and insulating ability;

FIG. 13 is an enlarged, broken, plan view of a structural element illustrated in FIG. 1, with a second panel member applied thereto, and FIG. 14 is an enlarged, broken, plan view of a structural element illustrated in FIG. 2.

DESCRIPTION OF THE PREFERRED EMBODIMENT

Structural elements 14 and 15 from which modular panel units are constructed are illustrated in FIGS. 1 and 2. A pressboard sheet 13 is constructed from fibers or filament to make a hard board of substantially ⅛ inch in thickness. When such pressboard sheets are to withstand burning to provide protection against fire, glass filaments, asbestos, a mixture thereof or the like, may be utilized in the pressboard construction. While the pressboard sheet 13 provides resistivity against the passage of heat, cold and sound, its ability to do so is substantially increased by the addition of a reflecting surface 60 on both sides thereof, as illustrated more specifically in FIGS. 13 and 14. The reflecting surface may be a fluid, paintlike substance which is well known in the art to be highly reflective and which may be applied by spraying and evenly spread to a desired thickness by an electronic applicator. Such a reflective surface may be provided by a foil, such as an aluminum foil which has a highly reflective surface. Either type of reflective material is adherred to the sides of the pressboard sheet 13.

The pressboard with the reflective surfaces has rectangular members 16 vertically disposed in spaced relation on one side thereof. The elements 16 are preferably made of a light gauge sheet material of approximately 0.021 inch in thickness. A box shaped structure is formed of the metal sheet to have spaced sides 1 inch in length and end walls which are approximately ¾ inch in length. The box shaped elements 16 are adherred or mechanically secured to the pressboard sheet 13 to form a structural element 14. A U-shaped element 20 constructed from the metal sheet to have substantially the same dimension as the element 16 extends horizontally or vertically over the ends thereof at the top and bottom and/or sides of the pressboard sheet 13, as illustrated in FIGS. 1 and 3 to 13.

A second structural element 15 is illustrated in FIG. 2 having a pressboard sheet 13 with reflective surfaces 60 thereon provided with box section structural elements 17, similar to the elements 16, extending horizontally at the top, bottom and across the area therebetween. The elements 17 are adherred or mechanically secured to one reflective side of the pressboard 13 to form the second structural element 15. The element 15 may have one or both side edges provided with the U-shaped element 20 to reinforce the edge where needed.

As illustrated in FIG. 3, a structural element 15 is joined to a structural element 14 which, in turn, is joined to a structural element 15 which is joined to an inner structural element 14 which has a pressboard sheet 13 applied to the box section elements 16 to provide spaces 18 therebetween. It will be noted in FIG. 3 and also in FIG. 7 that the inner panels 14 and 15 are shifted to the right relative to the outer elements 14 and 15 to thereby form a tongue 19 on one edge and a groove 21 on an opposite edge. A tongue 19 of one modular unit 28 extends in a groove 21 in a second unit 23, as illustrated in FIGS. 3, 5 to 8. The tongue 19 has the ends of the box section elements 17 tapered at 12 so as to readily extend into the groove 21 of a like modular unit 23. The metal of the box section elements 16 and 17 is reflective so that additional reflective area is provided thereby. It is understood however that the box section elements 16 and 17 could be made of other materials such as wood, plastic and the like in solid or box section form.

The modular units of FIGS. 4 and 6 are of thin construction, the one illustrated in FIG. 4 having two outside structural elements 15 and a central structural element 14 which is shifted to the right to form a tongue 24 having spaced deflectable projecting edges 25 which assist in the insertion of the tongue 24 in a groove 26 provided on the opposite edge of a like unit and also on the unit having the tongue. In this arrangement, the ends of the box section elements 17 are enclosed by the U-shaped elements 20 to provide closed edges at the open end of the groove 26. In FIG. 6, structural elements 14 are disposed on the outer sides of the modular unit 28 with a structural element 15 disposed therebetween. The structural element 15 is shifted to the right to form a tongue 29 having a tapered end 12 to permit the insertion of the tongue into a groove 31 at the opposite edge of a like unit located between the structural elements 14. A pressboard sheet 13 is applied to the inner structural element 14 and the opposite structural element 14 has horizontally disposed box sectional elements 17 employed in the groove having both ends confined by U-shaped members 20 to provide strength to the groove side.

The modular units 23 illustrated in FIG. 5 are shown having on the outer structural elements 14 an outer wall 32 which may be constructed of brick, stucco, paneling or the like. The outer wall is herein illustrated as being constructed of sheets 33 of plywood having the abuting edges covered by a batten strip 34. The inner structural element 15 has the box shaped elements 17 enclosed at the ends by the U-shaped elements 20. Outer pressboard sheets 13 are applied to the outer faces of the box section elements 17 with or without reflective surfaces on the opposite sides of the sheets. Plaster, plasterboard or the like may be applied to the inner pressboard sheets 13 secured thereto by any means such as by a quick-drying adhesive 30. The inner pressboard sheets could be applied by mechanical means such as by staples and the like.

In FIG. 8, a modular unit 23 is shown attached to a modular unit 35 by a tongue and groove connection to form a 45° corner. With this arrangement, the straight modular unit 23 has a groove 21 into which a tongue 19 of the modular unit 35 extends. The modular unit 35 has an outer pressboard sheet 36 provided with a 45° angle section 37 which is secured to box section elements 16. A similar pressboard sheet 38 having a 45° angle portion is likewise secured to the inner face of the box section elements 16 by an adhesive or by mechanical means. A pressboard sheet 13 on the structural element 15 is bent at a 45° angle at 39 with the extending ends cut to provide a chamfer 12. Three box section elements 16 are secured to the sheet 13 having the bent section 39, to the opposite side of which a similar pressboard sheet 13 is secured. A short structural element 15 is applied to the last said pressboard sheet 13 which have the box section elements 17 joined at the ends by U-shaped elements 20 to form the groove 21 which will be engaged by the tongue 19 of an adjacent modular unit.

In FIG. 9, a 90° corner construction 42 is illustrated formed by a modular panel unit 43 and 44 which are similar to the unit 23 with the exception of the provision of stepped ends 45 which mate with each other. The stepped ends are formed by offsetting the ends of the structural elements 14 and 15 so as to engage each other. The offset ends are secured together by an adhesive although mechanical securing means could be substituted therefor.

In FIG. 10, a right-angle corner 46 is made up of like modular units 47 with the end of one unit abutting the side face at the end of the other unit. In this relationship, the one unit 47 has the pressboard 13 of the structural element 14 extended at 48 to enclose the end of the other modular unit 47 with the units being secured together by adhesion or mechanical elements.

In FIG. 11, a modular unit 49 is illustrated as being joined to a like modular unit 49 by overlapping ends 51 which mate with each other. Two similar structural elements 14 and 15 form one-half of the unit while the other half is formed from similar structural elements 14 and 15. The central structural element 14 being pressboard is enclosed by the sheet 13. The two halves are laterally shifted to form a recess 52 and a tongue 53 on both of the ends. Each of the tongues 53 will be received by a recess 52 of different units 49 and be fixed to each other by an adhesive or mechanical means.

In FIG. 12, a thicker module unit 54 is illustrated having six spaces provided therein from the assembly of the structural elements 14 and 15 with the three central elements 14 and 15 shifted to the right to form a tongue 55 on one edge and a groove 56 on the opposite edge. The extending ends of the elements forming the tongue 55 are chamfered to provide sloping surfaces 12 to permit the tongue of one unit to extend within the groove of the other unit. Such thicker modular units have greater structural strength and resist the passage of heat, cold and passage through the pressboard or like sheets 13 and will be efficient when including one or two additional elements 14 and 15 and will drop in efficiency when further increased in thickness. The construction of the structural elements 14 and 15 was explained in detail hereinabove relative to the structure illustrated in FIGS. 13 and 14.

What is claimed is:

1. An insulating barrier to cold, heat, moisture and sound comprising a plurality of modular panel units in side by side relationship, each said modular unit comprising at least two spaced parallel pressboard panel members each having parallel outer and inner surfaces and opposed top and bottom and opposed side edges, reflective means on the entire outer and inner surfaces of each of said pressboard panels, a first set of generally parallel spacer members between said panels overlying said inner reflective surfaces secured to said inner surfaces of said pressboard panels and extending between one pair of opposed edges of said pressboard panels to space them from one another, each said spacer member of said first set comprising an enclosed tubular member spaced from and isolated from adjacent spacer members of said first set, a second set of parallel spacer members overlying said outer reflective surfaces of each of said pressboard panels secured to said outer surfaces of each of said pressboard panels and extending between the other pair of opposed edges of each of said pressboard panels, each said spacer members of said second set comprising an elongated member spaced from and isolated from adjacent spacer members of said second set, and an additional panel secured to each of the second sets of spacer members, whereby when the modular units are assembled in side-by-side and top-to-bottom relation, the first set of spacer members are aligned and the second sets of spacer members are aligned.

2. The combination set forth in claim 1 wherein said spacer members are made of metal.

3. The combination set forth in claim 1 wherein said spacer members have reflective means thereon.

4. The combination set forth in claim 1 wherein said spacer members are tubular in cross section.

5. The combination set forth in claim 1 wherein said spacer members are rectangular in cross section.

6. The combination set forth in claim 1 wherein said two pressboard panels and the first set of said spacer members associated with said two pressboard panels are shifted relative to said second set of spacer members and said additional panels in a plane parallel to the pressboard panels to form a tongue on one end and a groove on the other such that when the modular units are assembled the tongue of one unit engages the groove of the adjacent unit.

7. The combination set forth in claim 1 wherein the pressboard panels and additional panels of at least one modular unit are bent at an angle to provide a corner.

8. The combination set forth in claim 1 wherein said pressboard panels have a thickness of approximately 0.021 inch and said spacer members have a thickness of approximately ¾ of an inch.

9. A modular unit for producing an insulating barrier to cold, heat, moisture and sound comprising at least two pressboard panel members each having outer and inner surfaces and opposed top and bottom and opposed side edges, reflective means on the entire outer and inner surfaces of said pressboard panels, a first set of generally parallel spacer members overlying said inner reflective surfaces secured to said inner surfaces of said pressboard panels and extending between one pair of opposed edges of said pressboard panels to space them from one another, each said spacer member of said first set comprising an enclosed tubular member spaced from and isolated from adjacent spacer members of said first set, a second set of parallel spacer members overlying said outer reflective surfaces of each of said pressboard panels, secured to each of said outer surfaces of said pressboard panels and extending between the other pair of opposed edges of each of said pressboard panels, each said spacer members of said second set comprising an elongated member spaced from and isolated from adjacent spacer members of said second set, and an additional panel secured to each of the second sets of spacer members, whereby when the modular units are assembled in side-by-side and top-to-bottom relation, the first set of spacer members are aligned and the second sets of spacer members are aligned.

10. The combination set forth in claim 9 wherein said spacer members are made of metal.

11. The combination set forth in claim 9 wherein said spacer members have reflective means thereon.

12. The combination set forth in claim 9 wherein said spacer members are tubular in cross section.

13. The combination set forth in claim 9 wherein said spacer members are rectangular in cross section.

14. The combination set forth in claim 9 wherein said two of pressboard panels and the first set of said spacer members associated with said two pressboard panels are shifted relative to said second set of spacer members and said additional panels in a plane parallel to the pressboard panels to form a tongue on one end and a groove on the other such that when the modular units are assembled the tongue of one unit engages the groove of the adjacent unit.

15. The combination set forth in claim 9 wherein the pressboard panels and additional panels of at least one modular unit are bent at an angle to provide a corner.

16. An insulating barrier of cold, heat and sound comprising a plurality of modular units, each said modular unit comprising a plurality of pressboard panels each having outer and inner surfaces, opposed top and bottom and opposed side edges, reflective means on the outer and inner surfaces of each of said pressboard panels, spacer members overlying the reflective surfaces of said pressboard panels and secured thereto, one set of spacer members being provided between each adjacent pair of pressboard panels, the spacer members of each set being parallel to one another and extending between opposite edges of said pressboard panels, each said spacer member having at least three sides, two of said sides engaging the associated panels and a third side extending between said two sides, each said spacer member being spaced from and isolated from the adjacent spacer members, the spacer members of one set extending at substantially a right angle to the spacer members of an adjacent set, whereby when said modular units are assembled in side-by-side and top-to-bottom relation the spacer members of one modular unit are aligned with the spacer members of an adjacent unit.

17. The combination set forth in claim 16 wherein said spacer members are made of metal.

18. The combination set forth in claim 16 wherein said spacer members have reflective means thereon.

19. The combination set forth in claim 16 wherein said spacer members are tubular in cross section.

20. The combination set forth in claim 16 wherein said spacer members are rectangular in cross section.

21. The combination set forth in claim 16 wherein one said pair of pressboard panels and the first set of said spacer members associated with said pair of pressboard panels are shifted relative to said second set of spacer members and said additional panels in a plane parallel to the pressboard panels to form a tongue on one end and a groove on the other such that when the modular units are assembled the tongue of one unit engages the groove of the adjacent unit.

22. The combination set forth in claim 16 wherein the pressboard panels and additional panels of at least one modular unit are bent at an angle to provide a corner.

23. The combination set forth in claim 16 wherein said pressboard panels have a thickness of approximately 0.021 inch and said spacer members have a thickness of approximately ¾ of an inch.

24. A modular unit for producing an insulating barrier to cold, heat, moisture and sound comprising a plurality of modular units, each said modular unit comprising a plurality of pressboard panels each having outer and inner surfaces, opposed top and bottom and opposed side edges, reflective means on the outer and inner surfaces of each of said pressboard panels, spacer members overlying the reflective surfaces of said pressboard panels and secured thereto, one set of spacer members being provided between each adjacent pair of pressboard panels and on each of the outermost pressboard panels, the spacer members of each set being parallel to one another and extending between opposite edges of said pressboard panels, each said spacer member having at least three sides, two of said sides engaging the associated panels and a third side extending between said two sides, each said spacer member being spaced from and isolated from the adjacent spacer members, the spacer members of one set extending at substantially a right angle to the spacer members of an adjacent set, and an additional panel member secured to said spacer members on said outermost pressboard panel members, whereby when said modular units are assembled in side-by-side and top-to-bottom relation the spacer members of one modular unit are aligned with the spacer members of an adjacent unit.

25. The combination set forth in claim 24 wherein said spacer members are made of metal.

26. The combination set forth in claim 24 wherein said spacer members have reflective means thereon.

27. The combination set forth in claim 24 wherein said spacer members are tubular in cross section.

28. The combination set forth in claim 24 wherein said spacer members are rectangular in cross section.

29. The combination set forth in claim 24 wherein one said pair of pressboard panels and the first set of said spacer members associated with said pair of pressboard panels are shifted relative to said second set of spacer members and said additional panels in a plane parallel to the pressboard panels to form a tongue on one end and a groove on the other such that when the modular units are assembled the tongue of one unit engages the groove of the adjacent unit.

30. The combination set forth in claim 24 wherein the pressboard panels and additional panels of at least one modular unit are bent at an angle to provide a corner.

31. The combination set forth in claim 24 wherein said pressboard panels have a thickness of approximately 0.021 inch and said spacer members have a thickness of approximately $\frac{3}{4}$ of an inch.

* * * * *